United States Patent [19]

Seki

[11] Patent Number: 5,060,839

[45] Date of Patent: Oct. 29, 1991

[54] STROKE ADJUSTMENT APPARATUS FOR LIGHT PROJECTOR OF BUTTON SETTING MACHINE

[75] Inventor: Fumio Seki, Toyama, Japan

[73] Assignee: Yoshida Kogyo K. K., Tokyo, Japan

[21] Appl. No.: 468,358

[22] Filed: Jan. 22, 1990

[30] Foreign Application Priority Data

Feb. 3, 1989 [JP] Japan ..... 1-12489[U]

[51] Int. Cl.[5] ..... A41H 37/10

[52] U.S. Cl. ..... 227/18; 227/119; 227/156; 29/721

[58] Field of Search ..... 227/15, 18, 119, 131, 227/138, 156; 83/520, 521; 29/721

[56] References Cited

U.S. PATENT DOCUMENTS

| | | | |
|---|---|---|---|
| 3,964,661 | 6/1976 | Schmidt et al. | 227/18 |
| 4,573,834 | 3/1986 | Nasu | 83/521 X |
| 4,605,150 | 8/1986 | Ikehara | 227/18 |
| 4,615,473 | 10/1986 | Taga | 227/15 |
| 4,645,110 | 2/1987 | Taga | 227/2 |
| 4,723,357 | 2/1988 | Suyama et al. | 227/18 X |
| 4,765,524 | 8/1988 | Yoshieda | 227/18 |
| 4,799,611 | 1/1989 | Taga | 227/18 |
| 4,840,301 | 6/1989 | Seki | 227/139 |

FOREIGN PATENT DOCUMENTS

| | | |
|---|---|---|
| 63-21534 | 7/1985 | Japan . |
| 1-26731 | 7/1985 | Japan . |

*Primary Examiner*—Frank T. Yost
*Assistant Examiner*—Rinaldi Rada
*Attorney, Agent, or Firm*—Hill, Van Santen, Steadman & Simpson

[57] ABSTRACT

An apparatus for adjusting the stroke of a light projector of a button setting machine includes a rod connected at its one end to the light projector, a holder holding the opposite end of the rod and pivotably connected to one end of a pivotable actuating lever pivotally movable in response to the reciprocating movement of an upper pusher, a leaf spring acting between the actuating lever and the rod to urge the latter upwardly, a spring urging the actuating lever to turn in a direction to retract the light projector from a path of movement of a punch, and an adjustable stopper engageable with the actuating lever to limit pivotal movement of the same against the force of the spring. With this construction, the light projector has a stroke considerably shorter than the stroke of the upper pusher and can be adjusted independently of the stroke of the upper pusher.

5 Claims, 2 Drawing Sheets

STROKE ADJUSTMENT APPARATUS FOR LIGHT PROJECTOR OF BUTTON SETTING MACHINE

FIELD OF THE INVENTION

1. Field of the Invention

The present invention relates generally to a button setting machine having a light projector reciprocally movable for indicating a position on the garment fabric where two elements of a garment fastener such as a button are to be attached by the button setting machine, and more particularly to an apparatus for adjusting the stroke of such optical position indicator of the button setting machine.

2. Description of the Prior Art

Optical position indicators composed of light projectors are incorporated in button setting machines for indicating an accurate position on the garment fabric where upper and lower elements of a fastener, such as a stud button for denim jeans, are to be attached by and between a punch and a die of the button setting machine. For an accurate positioning, it is desirable that the light projector is disposed directly below the punch. The light projector thus disposed needs to be retractable from the path of movement of the punch to avoid collision with the punch.

With the foregoing requirements in view, the conventional light projector is pivotably connected by a holder to an upper pusher provided for receiving an upper fastener element from a chute and for guiding the upper fastener element into the path of movement of the punch.

The light projector thus attached has the same stroke as the upper pusher. In case of the attachment of an upper fastener element having an ornamental character or mark to be oriented, the upper fastener element while being guided by the upper pusher must be rotated until it assumes a desired orientation. Such fastener element guiding operation needs a long guide distance which necessarily elongates the stroke of the upper pusher. With this elongated stroke of the upper pusher, the stroke of the light projector becomes longer than it should be. Thus, the reciprocating movement of the light projector having such undue stroke involves a loss or waste in time and space and is likely to cause a damage or breaking of lead wires of the light projector due to interference with a proximate part of the button setting machine.

SUMMARY OF THE INVENTION

With the foregoing difficulties in view, it is an object of the present invention to provide an apparatus for adjusting the stroke of a light projector of a button setting machine in such a manner that the stroke of the light projector is shorter than the stroke of an upper pusher of the button setting machine, thereby eliminating a loss or waste in space and time from the reciprocating movement of the light projector.

A stroke adjustment apparatus according to the present invention includes an actuating lever pivotally movable about a shaft in response to the reciprocating movement of an upper pusher of a button setting machine, and a holder pivotably connected to one end of the actuating lever and holding a rod connected at its one end to a light projector. A bias means is provided for urging the rod upwardly, and a spring means is provided for urging the actuating lever in a direction to retract the light projector from the path of movement of a punch of the button setting machine. An adjustable stopper is engageable with the actuating lever to limit pivotal movement of the same in the light-projector retracting direction against the force of the spring means.

With this construction, as the upper pusher moves backward, the actuating lever is turned about the shaft in a direction to retract the light projector from the path of movement of the punch under the force of the bias means. When the light projector is fully retracted, an upper portion of the actuating lever abuts against the stopper whereby a further pivotal movement of the actuating lever is prohibited. The backward movement of the upper pusher further continues in independence of the termination of the retracting movement of the light projector. Thus, the stroke of the light projector is considerably shorter than the stroke of the upper pusher. With the shortness of its reciprocating stroke, the light projector is substantially free from a breaking of lead wires which would otherwise be caused by interference with a proximate part of the button setting machine.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

The present invention will be described hereinbelow in detail with reference to a preferred embodiment shown in the accompanying drawings.

Figure 1:
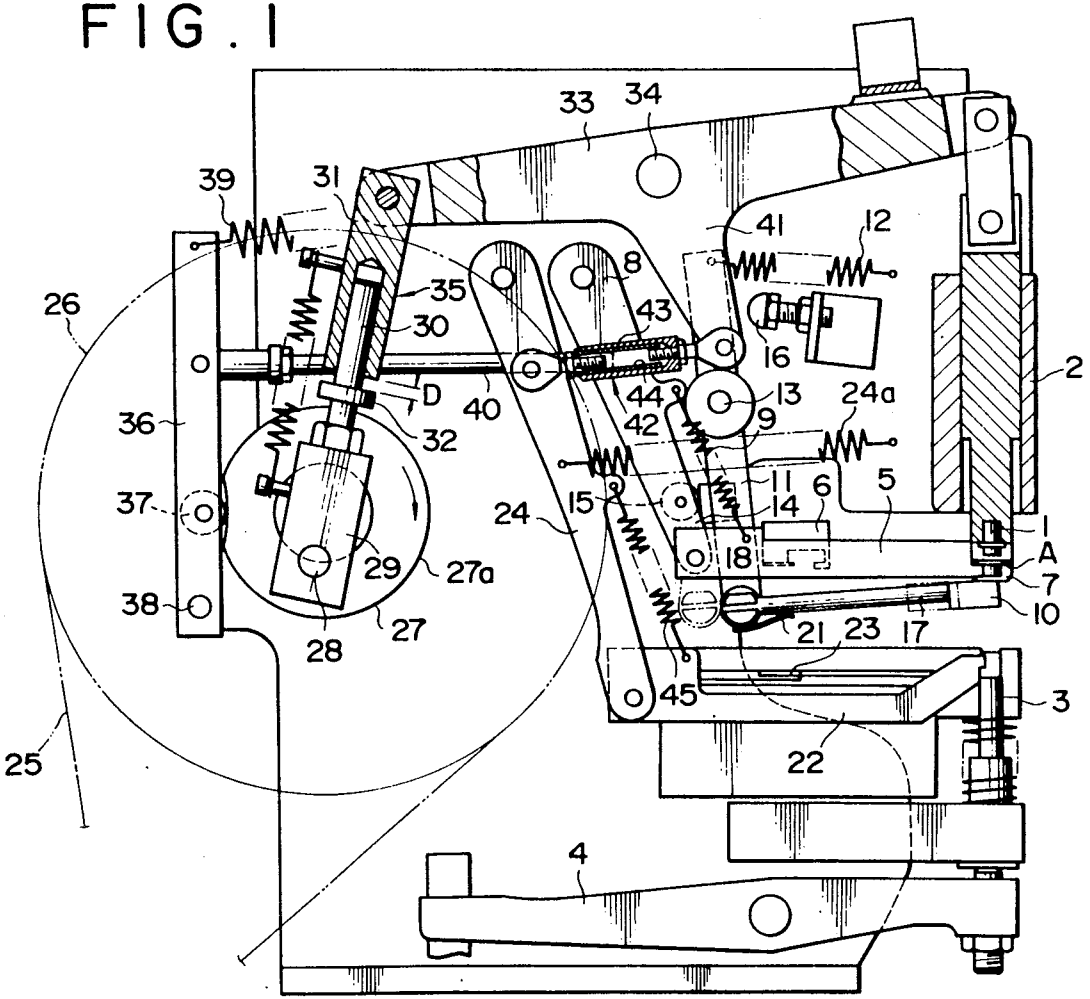
FIG. 1 is a front elevational view, partly in cross section, of a button setting machine incorporating an apparatus for adjusting the stroke of a light projector according to the present invention.

FIG. 1 shows a button setting machine incorporating an apparatus for adjusting the stroke of a light projector according to the present invention.

The button setting machine includes a punch 1 for forcing an upper element A of a garment fastener such as a stud button into clinching engagement with a lower element (not shown) of the garment fastener. The punch 1 is reciprocable vertically with respect to a frame 2 of the button setting machine. A die 3 is supported by the frame 2 directly below the punch 1 for holing thereon the lower fastener element. The punch 1 and the die 3 cooperate with each other to clinch the upper and lower fastener elements with a garment fabric disposed therebetween. The die 3 is connected at its lower end to one end of a lever 4 which is connected at its opposite end to a shock absorber (not shown) for taking up or absorbing a shock force applied to the die 3 when the upper and lower fastener elements are clinched together.

The button setting machine further includes an upper pusher 5 for receiving an upper fastener element A at a time from an upper chute 6 and for supplying the upper fastener element A to an upper pocket 7 disposed immediately below the punch 1 for holding the upper fastener element A. The upper pusher 5 is pivoted to an upper pusher lever 8 so that it is movable alternately back and forth along a horizontal path in response to the pivotal movement of the upper pusher lever 8. A tension coil spring 9 acts between the upper pusher lever 8 and the upper pusher 5 to urge the latter slightly upwardly for holding the horizontal posture of the upper pusher 5.

A light projector 10 is associated with the button setting machine for indicating a position on the garment fabric where a garment fastener is to be attached. The light projector 10 is pivotably connected to one end of an actuating lever 11, the opposite end of the actuating lever 11 being connected to one end of a tension coil spring 12. The opposite end of the tension coil spring 12 is connected to the frame 2 so that the actuating lever 11 is normally urged by the tension coil spring 12 in a direction to retract the light projector 12 from the path of movement of the punch 1. The actuating lever 11 is pivoted on a horizontal shaft 13 secured to the frame 2. The actuating lever 11 is provided with an abutment block 14 which is held in contact with a roller 15 on the upper pusher lever 8 during a portion of the reciprocating stroke of the upper pusher 5. The abutment block 14 may be integral with the actuating lever 11. Alternatively, the abutment block 14 may be omitted in which instance the roller 15 directly engages a portion of the actuating lever 11. A stopper 16 is engageable with the actuating lever 11 to limit pivotal movement of the same for restricting the backward stroke of the light projector 10. The stopper 16 comprises a screw and hence is adjustable in position so that the reciprocating stroke of the light projector 10 can be adjusted by turning the stopper 16 in either direction.

Figure 2:
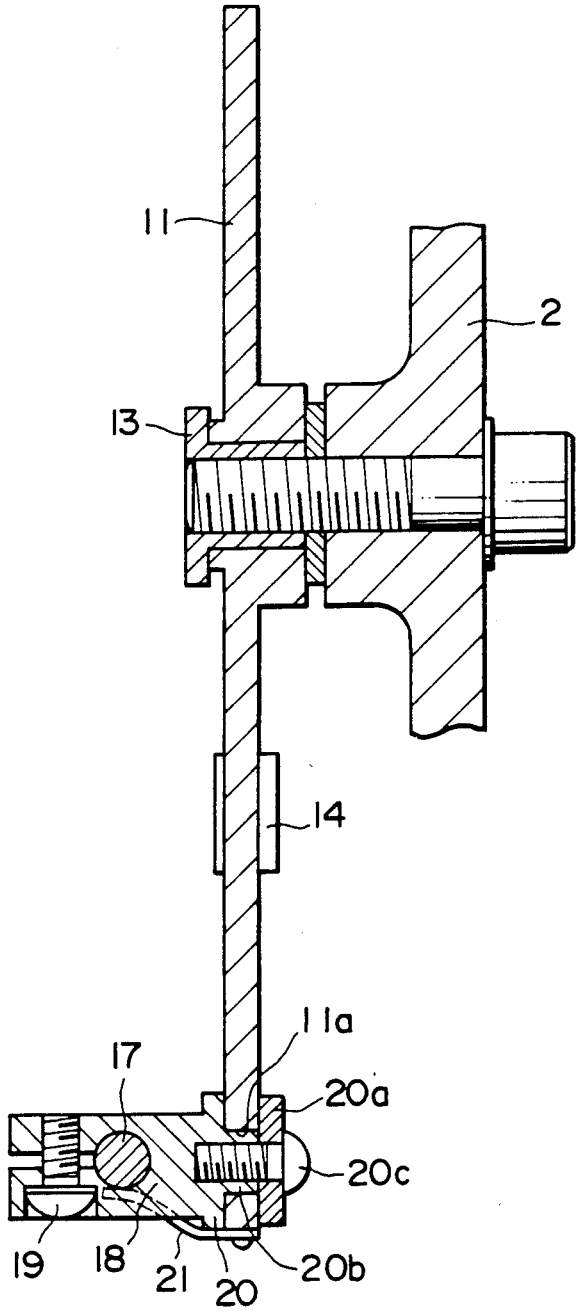
FIG. 2 is an enlarged cross-sectional view illustrative of the connection between the light projector and an actuating lever of the stroke adjustment apparatus shown in FIG. 1.

The light projector 10 includes a cylindrical rod 17 having one end grasped by a split holder 18. As shown in FIG. 2, the split holder 18 is split along a portion thereof, and mounted in a position at least partially surrounding, or astride the cylindrical rod 17 and secured to the same by a screw 19. The holder 18 has a flanged end portion 20 facing in a direction perpendicular to the axis of the cylindrical rod 17 and pivotably connected to the lower end of the actuating lever 11, with the actuating lever 11 held between the flanged end portion 20 and a retainer plate **20*a*. The flanged end portion 20 has a cylindrical projection 20*b* extending transverse to the axis of the cylindrical rod 17 and slidably received in a hole 11*a* in the lower end of the actuating lever 11. The projection 20*b* is secured to the retainer plate 20*a* by a screw 20*c*. With this pin-and-hole coupling, the light projector 10 is prevented from oscillating laterally during its reciprocation. A bias means comprising a leaf spring 21 is connected at one end to the lower end of the actuating lever 11 and has the opposite end acting on the underside of the cylindrical rod 17 for urging the latter in a direction to lift the light projector 10. The leaf spring 21 may be replaced by a tension spring, not shown, acting between the actuating lever 11 and the cylindrical rod 17 to urge the light projector 10** upwardly.

A lower pusher 22 is movably supported on the frame 2 for receiving a lower fastener element at a time from a lower chute 23 and for supplying the lower fastener element to the die 3. The lower pusher 22 is pivoted to a lower pusher lever 24 and horizontally reciprocable in response to the pivotal movement of the lower pusher lever 24. When the lower pusher 22 is fully retracted, the forward end of the lower pusher 22 is disposed behind (left side in FIG. 1) the lower end of the lower chute 23.

The punch 1, the upper pusher 5 and the lower pusher 22 are all driven by a common drive unit including a fly wheel 26 continuously rotated by an electric motor (not shown) via a V-belt 25. A radial disk cam 27 is concentrically mounted on a central shaft of the fly wheel 26 via a single-revolution clutch (not shown). The single-revolution clutch is engaged to connect the continuously rotating fly wheel 26 and the cam 27 when a foot pedal (not shown) is depressed. When the cam 27 completes one revolution, the single-revolution clutch is disengaged to separate the cam 27 from the continuously rotating fly wheel 26.

The cam 27 has an eccentric pin 28 projecting from an end face thereof and pivoted to a lower end of a crank lever 29. The crank lever 29 is directly connected at its upper end with a shaft 30 slidably received in a cylinder member 31. The shaft 30 has an actuator in the form of an annular flange 32 engageable with the lower end of the cylinder member 31. The actuating flange 32 is spaced a distance D from the lower end of the cylinder member 31 when the punch 1 is in its uppermost position. The upper end of the cylinder member 31 is pivoted to one end of a T-shaped lever 33, the opposite end of the T-shaped lever 33 being operatively connected to an upper end of the punch 1. The T-shaped lever 33 is pivotally movable about a shaft 34 to reciprocate the punch 1 vertically toward and away from the die 3. With this construction, when the cam 27 is driven to rotate, the shaft 30 immediately starts moving upwardly into the cylinder member 31. In this instance, however, due to the space D provided between the annular actuating flange 32 and the lower end of the cylinder member 31, pivotal movement of the T-shaped lever 33 does not take place until the annular actuating flange 32 on the shaft 30 abuts against the lower end of the cylinder member 31. Thus, the shaft 30 and the cylinder member 31 jointly constitute a lost motion mechanism 35 which produces the lost motion or the delay between the movement of a driver (cam 27 in the illustrated embodiment) and the movement of a follower (the T-shaped lever 33 in the illustrated embodiment).

A vertical cam lever 36 is pivotally connected at its lower end to a horizontal shaft 38 secured to the frame 2 and has a roller follower 23 rollingly engageable with a cam surface **27*a* of the cam 27. When cam 27 rotates, the cam lever 36 angularly oscillates about the shaft 38. The cam lever 36 is normally urged by a tension coil spring 39 toward the cam 27. The cam lever 36 is pivoted at its upper end portion to one end of a horizontal actuating rod 40, the opposite end of the actuating rod 40 being connected with the upper pusher lever 8**.

The T-shaped lever 33 has a vertical arm 41 extending downwardly from a substantially central portion thereof and pivotally connected at its distal end to one end of an expansion pipe joint 42. The opposite end of the expansion pipe joint 42 is pivoted to the lower pusher lever 24 adjacent to an upper end thereof. The expansion pipe joint 42 is composed of an outer pipe 43 connected to the arm 41 and an inner pipe 44 connected to the lower pusher lever 24 and slidably received in the outer pipe 43. With the expansion pipe joint 42 thus provided, only the pivotal movement of the T-shaped lever 33 in the clockwise direction is transmitted to the lower pusher lever 24, and the pivotal movement of the T-shaped lever 33 in the counterclockwise direction has no effect on the movement of the lower pusher lever 24. The lower pusher lever 24 follows the pivotal movement of the T-shaped lever 33 in the counterclockwise direction, however, this angular movement of the lower pusher lever 24 is caused by the force of a tension coil spring 24*a* and not resulted from the pivotal movement of the T-shaped lever 33. Consequently, when a lower fastener element jams as it is fed by the lower pusher 22 toward the die 3, advancing movement of the lower pusher 22 is interrupted by the jamming lower fastener element while at the same time the T-shaped lever 33 continues its pivotal movement in the counterclockwise direction. If the T-shaped lever 33 and the lower pusher lever 24 are directly connected together, the lower pusher lever 24 is forced by the T-shaped lever 33 to turn counterclockwise, thereby forcibly advancing the lower pusher 22 even when jamming of the lower fastener element takes place. Such forcible feeding of the jamming fastener element would damage the button setting machine.

A tension coil spring 45 acts between the lower pusher lever 24 and the lower pusher 22 to urge the latter slightly upwardly so as not to sink the forward end of the lower pusher 22.

The button setting machine of the foregoing construction operates as follows. For purposes of illustration, operation of the button setting machine begins from a condition shown in FIG. 1. When a start switch (not shown) of the button setting machine is turned on, the motor-driven fly wheel 26 rotates continuously. In this instance, the single-revolution clutch is in the disengaged state so that the rotational movement of the fly wheel 26 is not transmitted to the cam 27. The light projector 10 projects a light beam passing along a common vertical axis of the punch 1 and the die 3. The light beam produces a light spot on a garment fabric when the latter is disposed between the light projector 10 and the die 3. After a position on the garment fabric where the upper and lower fastener elements are to be attached has been set in registry with the light spot, a foot pedal is depressed whereupon the single-revolution clutch is engaged to connect the continuously rotating fly wheel 26 and the cam 27, thereby rotating the cam 27 in the clockwise direction as indicated by the arrow shown in FIG. 1. The clockwise movement of the cam 27 causes the roller follower 37 to relatively move from a flat cam surface to an arcuate cam surface 27*a* so that the cam lever 36 is turned counterclockwise about the shaft 38 against the force of the tension coil spring 39. With this counterclockwise movement of the cam lever 36, the actuating rod 40 is retracted to turn the upper pusher lever 8 clockwise, thereby retracting the upper pusher 5 from the path of movement of the punch 1.

During that time, as the upper pusher lever 8 turns in the clockwise direction, the actuating lever 11 turns about the shaft 13 in the same direction under the force of the tension coil spring 12. This angular movement of the actuating lever 11 discontinues when an upper portion of the actuating lever 11 abuts against the stopper 16. In this instance, the light projector 10 is disposed in its fully retracted position indicated by the phantom lines shown in FIG. 1. The angular movement of the lower pusher lever 24 continues to further retract the upper pusher 5 until the forward end of the upper pusher 5 is disposed behind the lower end of the upper chute 6. Thus, the backward stroke of the light projector 10 is considerably shorter than the backward stroke of the upper pusher 5. The reciprocating movement of the light projector 10 does not involve a wasteful extension and is unlikely to cause a breaking of lead wires of the light projector 10.

The retracting movement of the upper pusher 5 is completed before the cam 27 advances through an angular distance which is equivalent to a linear advancing movement of the shaft 30 over the distance D (i.e., the lost motion) provided by the lost motion mechanism 35. With the action of the lost motion mechanism 35, the T-shaped lever 33 is kept immovable so that downward movement of the punch 1 never occurs before the upper pusher 5 is fully retracted.

A continuing clockwise movement of the cam 27 causes the eccentric pin 28 to further advance the shaft 30 into the cylinder member 31 whereupon the annular actuating flange 32 on the shaft 30 is brought into abutment with the lower end of the cylinder member 31. Thereafter, the shaft 30 and the cylinder member 31 move upwardly in unison with each other, thus causing the T-shaped lever 33 to turn about the shaft 34 in the clockwise direction to thereby lower the punch 1 toward the die 3. The fully retracted position of the light projector 10, that is, the stroke of the light projector 10 can be adjusted by turning the threaded stopper 16 in either direction.

As described above, the stroke of the light projector can be adjusted separately from the stroke of the upper pusher without the necessity of providing a separate drive unit used exclusively for reciprocating the light projector. Since the stroke of the light projector is considerably shorter than the stroke of the upper pusher, the reciprocating movement of the light projector can be achieved without loss. Furthermore, the light projector having such short stroke is unlikely to cause a breaking of lead wires and hence is easy to maintain.

Obviously, various modifications and variations of the present invention are possible in the light of the above teaching. It is therefore to be understood that within the scope of the appended claims the invention may be practiced otherwise than as specifically described.

What is claimed is:

1. An apparatus for adjusting a stroke of a light projector incorporated in a button setting machine having a horizontally reciprocable upper pusher for feeding a fastener element into a path of movement of a vertically reciprocable punch, said apparatus comprising:

(a) an actuating lever pivotally movable about a shaft in response to the reciprocating movement of the upper pusher;

(b) a holder pivotably connected to one end of said actuating lever and holding a rod, said rod having an end connected to a light projector;

(c) bias means for urging said rod upwardly;

(d) spring means for urging said actuating lever in a direction to retract said light projector from the path of movement of the punch; and (e) an adjustable stopper engageable with said actuating lever to limit pivotal movement of said actuating lever in said direction against the force of said spring means.

2. An apparatus according to claim 1, wherein said holder is split along a portion thereof and mounted in a position at least partially surrounding said rod.

3. An apparatus according to claim 1, wherein said one end of said actuating lever has a hole, and said holder is disposed on a first side of said actuating lever and has a lateral projection extending transverse to a longitudinal axis of said rod and slidably received in said hole in said actuating lever, said apparatus further including a retainer plate disposed on a side of said actuating lever opposite said first side, said retainer plate being secured to said lateral projection.

4. An apparatus according to claim 1, wherein said bias means comprises a leaf spring having one end connected to said actuating lever and an opposite end acting on an underside of said rod.

5. An apparatus according to claim 1, wherein said adjustable stopper comprises a screw.

* * * * *